US012114707B2

(12) United States Patent
Fursa

(10) Patent No.: US 12,114,707 B2
(45) Date of Patent: Oct. 15, 2024

(54) AEROSOL-GENERATING DEVICE WITH OPTICAL MEANS FOR STATE DETECTION

(71) Applicant: Philip Morris Products S.A., Neuchatel (CH)

(72) Inventor: Oleg Fursa, Gempenach (CH)

(73) Assignee: Philip Morris Products S.A., Neuchatel (CH)

( * ) Notice: Subject to any disclaimer, the term of this patent is extended or adjusted under 35 U.S.C. 154(b) by 384 days.

(21) Appl. No.: 17/618,674

(22) PCT Filed: Jun. 11, 2020

(86) PCT No.: PCT/EP2020/066172
§ 371 (c)(1),
(2) Date: Dec. 13, 2021

(87) PCT Pub. No.: WO2020/249661
PCT Pub. Date: Dec. 17, 2020

(65) Prior Publication Data

US 2022/0240591 A1 Aug. 4, 2022

(30) Foreign Application Priority Data

Jun. 14, 2019 (EP) ..... 19405008

(51) Int. Cl.
*A24F 40/51* (2020.01)
*A24F 40/20* (2020.01)
(Continued)

(52) U.S. Cl.
CPC ..... *A24F 40/51* (2020.01); *A24F 40/20* (2020.01); *A24F 40/42* (2020.01); *A24F 40/53* (2020.01)

(58) Field of Classification Search
CPC ..... A24F 40/51; A24F 40/53; A24F 40/20; A24F 40/42
(Continued)

(56) References Cited

U.S. PATENT DOCUMENTS 10,206,429 B2 * 2/2019 Davis ..... H05B 3/04
11,134,544 B2 * 9/2021 Chang ..... A24F 40/46
(Continued)

FOREIGN PATENT DOCUMENTS

JP 2017-501682 A 1/2017
JP 2018-527894 A 9/2018
(Continued)

OTHER PUBLICATIONS

International Search Report and Written Opinion issued on Sep. 15, 2020 in PCT/EP2020/066172 filed on Jun. 11, 2020.
(Continued)

*Primary Examiner* — Abdullah A Riyami
*Assistant Examiner* — Vladimir Imas
(74) *Attorney, Agent, or Firm* — Oblon, McClelland, Maier & Neustadt, L.L.P.

(57) ABSTRACT

An electrically heatable aerosol-generating device to heat an aerosol-forming substrate is provided, the device including: a receiving cavity to removably receive an aerosol-generating article including the substrate; an electrical heater to heat the substrate when the article is received in the cavity; and a state detector to detect a presence of at least one specific state in the cavity and including a radiation emitter to emit radiation into the cavity, and a radiation sensor to detect a portion of the emitted radiation being reflected from an interior of the cavity and indicative of the presence of the specific state, the emitter and the sensor are arranged outside the cavity such that the emitter and the sensor are not in fluid communication with the interior of the cavity, and at least a
(Continued)

part of the detector is arranged close to or adjacent to a distal end portion of the cavity.

15 Claims, 4 Drawing Sheets

(51) Int. Cl.
*A24F 40/42* (2020.01)
*A24F 40/53* (2020.01)

(58) Field of Classification Search
USPC ..... 131/329
See application file for complete search history.

(56) References Cited

U.S. PATENT DOCUMENTS

| | | | | |
|---|---|---|---|---|
| 11,644,365 | B2 * | 5/2023 | Bessant | G01J 5/0802 250/338.3 |
| 2005/0068528 | A1 | 3/2005 | Altobelli et al. | |
| 2008/0212094 | A1 | 9/2008 | Altobelli et al. | |
| 2009/0213373 | A1 | 8/2009 | Altobelli et al. | |
| 2011/0079220 | A1 | 4/2011 | Altobelli et al. | |
| 2013/0255702 | A1 * | 10/2013 | Griffith, Jr. | A24F 15/01 131/328 |
| 2013/0298905 | A1 * | 11/2013 | Levin | A24F 40/90 128/202.21 |
| 2014/0209094 | A1 | 7/2014 | Altobelli et al. | |
| 2016/0157523 | A1 | 6/2016 | Liu | |
| 2016/0302488 | A1 | 10/2016 | Fernando et al. | |
| 2017/0199067 | A1 | 7/2017 | Altobelli et al. | |
| 2017/0340009 | A1 | 11/2017 | Hon | |
| 2017/0347710 | A1 | 12/2017 | Hon | |
| 2019/0094056 | A1 | 3/2019 | Altobelli et al. | |
| 2020/0178608 | A1 | 6/2020 | Fernando et al. | |
| 2021/0378309 | A1 * | 12/2021 | Reevell | A24F 40/46 |

FOREIGN PATENT DOCUMENTS

| | | | |
|---|---|---|---|
| RU | 2 676 506 | C1 | 12/2018 |
| WO | WO 2017/207442 | A1 | 12/2017 |
| WO | WO 2019/088589 | A2 | 5/2019 |
| WO | WO 2020/216762 | A1 | 10/2020 |
| WO | WO 2020/216765 | A1 | 10/2020 |

OTHER PUBLICATIONS

International Preliminary Report on Patentability issued on Aug. 10, 2021 in PCT/EP2020/066172 filed on Jun. 11, 2020.
Russian Search Report issued on Oct. 9, 2023 in Russian Patent Application No. 2022100428 (with English translation), 4 pages.
Japanese Office Action dated Jul. 1, 2024 issued in Japanese Patent Application No. 2021-573599, with English Translation, total 7 pages.

* cited by examiner

AEROSOL-GENERATING DEVICE WITH OPTICAL MEANS FOR STATE DETECTION

CROSS-REFERENCE TO RELATED APPLICATIONS

This application is a U.S. national stage application of PCT/EP2020/066172, filed on Jun. 11, 2020, which is based upon and claims the benefit of priority under 35 U.S.C. § 119 from European patent application no. 19405008.4, filed Jun. 14, 2019, the entire contents of each of which are incorporated herein by reference.

TECHNICAL FIELD

The present invention relates to an electrically heated aerosol-generating device with means for detecting the presence of at least one specific state in a receiving cavity of the device.

DESCRIPTION OF THE RELATED ART

Aerosol-generating devices used for generating an inhalable aerosol by electrically heating an aerosol-forming substrate are generally known from prior art. Such devices may comprise a cavity for removably receiving at least a portion of an aerosol-generating article that includes the aerosol-forming substrate to be heated. The devices further comprise an electrical heater for heating the substrate when the article is received in the cavity. For various purposes, detection of certain conditions and states in the receiving cavity is important to ensure a proper functioning of the device. For example, it is important to accurately detect a user's puff for countering variations of the heating temperature when a user takes a puff. In other cases, it may be required to detect the presence or a displacement of an aerosol-generating article in the receiving cavity in order to enable or disable the heating process. Likewise, recognition of the article type may be required to ensure that only appropriate articles are used with a respective device. Such kind of state detection typically is realized by sensor means which are arranged inside the cavity. There, the sensor means inevitably are exposed to heat and moisture and even more—in case of inductively heating devices—to high-frequency electromagnetic fields. Often, such effects make the state detection susceptible to interference. In addition, the sensor may get damaged, in particular due to mechanical effects during cleansing of the cavity or during insertion or removal of the article into or from the cavity.

Therefore, it would be desirable to have an electrically heated aerosol-generating device with the advantages of prior art solutions but without their limitations. In particular, it would be desirable to have an electrically heated aerosol-generating device providing improved means for detecting the presence of at least one specific state in the receiving cavity of the device.

SUMMARY

According to the invention there is provided an electrically heated aerosol-generating device for heating an aerosol-forming substrate capable to form an inhalable aerosol when heated. The device comprises a receiving cavity for removably receiving at least a portion of an aerosol-generating article that includes the aerosol-forming substrate to be heated. The device further comprises an electrical heater for heating the aerosol-forming substrate when the article is received in the receiving cavity. In addition, the device comprises a state detector for detecting the presence of at least one specific state in the receiving cavity. The state detector comprises a radiation emitter arranged and configured to emit radiation into the receiving cavity. The state detector further comprises a radiation sensor arranged and configured to detect a portion of the emitted radiation being reflected from the interior of the receiving cavity and being indicative for the presence of the at least one specific state.

BRIEF DESCRIPTION OF THE DRAWINGS

The invention will be further described, by way of example only, with reference to the accompanying drawings, in which.

DETAILED DESCRIPTION

Figure 1:
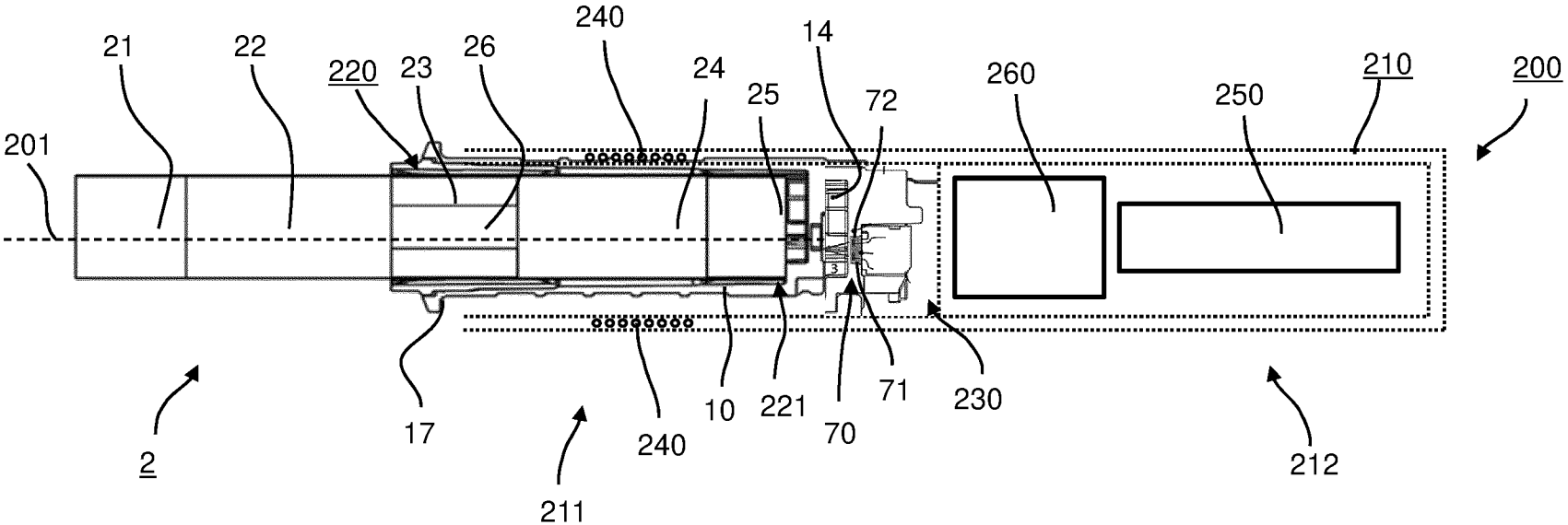
FIG. 1 schematically illustrates an exemplary embodiment of an aerosol-generating device according to the present invention in a sectional view.

According to the invention it has been recognized that a state detector emitting radiation into the receiving chamber and detecting radiation reflected from the interior of the receiving chamber advantageously allows for a remote detection of a state in the receiving cavity. Due to this, the radiation emitter and the radiation sensor may be arranged at a position remote from any adverse conditions in the receiving chamber such as heat, moisture and electromagnetic fields.

In addition, a radiation-based state detector allows for a fast and instantaneous state detection without any delay between the occurrence of a specific state or of a state change and its detectability at a position of the state detector.

In general, the state detector may be configured to detect the presence of one specific state in the receiving cavity or to detect the presence of a plurality of different states in the receiving cavity. In particular, the state detector may be configured to at least one of:

detect a user's puff by detecting a change of the intensity of the reflected radiation due to a change of the air density in the receiving cavity occurring during a user's puff;

detect the presence of an aerosol-generating article in the receiving cavity by detecting a change of the intensity of the reflected radiation upon insertion of the aerosol-generating article into the receiving cavity;

detect a displacement of an aerosol-generating article in the receiving cavity by detecting a deviation of the intensity of the reflected radiation from a predefined value of the intensity of the reflected radiation; or recognize a specific type of an aerosol-generating article received in the receiving cavity by detecting a predefined value of the intensity of the reflected radiation corresponding to the specific article type.

As used herein, the term "radiation" refers to electromagnetic radiation, in particular to light, preferably to visible light in the spectral range of 400 nm to 700 nm and/or to infrared (IR) light in the spectral range of 700 nm to 1 mm, in particular to near-infrared (NIR) light in the spectral range of 700 nm to 1.4 μm, and/or to ultraviolet (UV) light in the spectral range of 100 nm to 400 nm.

Accordingly, the radiation emitter may be configured to emit radiation in the spectral range between 100 nm and 1400 nm, in particular between 100 nm and 400 nm, and/or between 400 nm and 700 nm, and/or between 700 nm and 1400 nm. In particular, the radiation emitter may be configured to emit light in the spectral range between 100 nm and 1400 nm, in particular visible light in the spectral range of 400 nm to 700 nm; and/or infrared (IR) light in the spectral range of 700 nm to 1 mm, in particular near-infrared (NIR) light in the spectral range of 700 nm to 1.4 μm; and/or ultraviolet (UV) light in the spectral range of 100 nm to 400 nm.

Accordingly, the radiation emitter may be a light emitter, in particular a visible light emitter or an infrared (IR) light emitter, in particular a near-infrared (NIR) light emitter, or a ultraviolet (UV) light emitter.

The radiation emitter preferably comprises a light-emitting diode (LED). LEDs are available at low costs and have a small, space-saving overall size which proves advantageous with regard to a compact design of the state detector. Depending on the spectral range of the radiation to be emitted, the radiation emitter may comprise a white or a green or a red or an infrared LED, or combinations thereof. As used herein, a green LED or a red LED denotes a LED that emits radiation in a narrow band of wavelengths having green or red as primary color. Such kind of LEDs may also be denoted as monochromatic LEDs. Accordingly, the radiation emitter may comprise one or more monochromatic radiation sources. A white diode denotes a LED that emits radiation in a broad band of wavelengths covering a large portion of visible spectral range between 400 nm and 700 nm between or the entire visible spectral range between 400 nm and 700 nm. A white LED may comprise individual LEDs that emit three primary colors "red", "green" and "blue", which are mixed to form white light. Alternatively, a white LED may comprise a phosphor material to convert monochromatic light from a blue or UV LED to broad-spectrum white light, similar to a fluorescent lamp.

Preferably, the radiation detector comprises a photodiode. Like LEDs, photo diodes also are available at low costs and also have a small, space-saving overall size which proves advantageous with regard to a compact design of the state detector. The spectral sensitivity of the radiation detector preferably is chosen such as to match at least a portion of the spectral range of the emitted radiation, that is, the emission spectrum of the radiation emitter. For example, the radiation detector may comprise a silicon (Si) photodiode having a spectral sensitivity in the range of 190 nm to 1100 nm, or a germanium (Ge) photodiode having a spectral sensitivity in the range of 400 nm to 1700 nm, or an indium gallium arsenide (InGaAs) photodiode having a spectral sensitivity in the range of 800 nm to 2600 nm.

Preferably, the radiation emitter and the radiation detector are arranged outside the receiving cavity. Advantageously, this enables to completely insulate the radiation emitter and the radiation sensor from any adverse conditions in the receiving chamber. In addition, an arrangement outside the receiving cavity allows for a simple cavity design. In particular, the cavity does not need to comprise any electrical feedthrough for connecting the radiation emitter and the radiation sensor. For this reason, the cavity may comprise a closed inner surface. Advantageously, this allows for shielding also other parts of the aerosol-generating device, for example electronic components, from adverse effects originating from the interior of the cavity. Apart from that, an arrangement outside the receiving cavity prevents the sensor from being damaged, for example due to mechanical effects during cleansing of the cavity or during insertion or removal of the article into or from the receiving cavity.

Preferably, the radiation emitter and the radiation detector are not in fluid communication with the interior of the receiving cavity which proves advantageous for the same reasons discussed above.

The radiation emitter and the radiation detector may be separated from the interior of the receiving cavity by a wall member. The wall member forms at least a portion of the receiving cavity. In particular, the wall member may form a portion of a wall defining the receiving cavity.

In order to enable the radiation to be emitted into the receiving cavity and to be reflected outwards towards the radiation sensor, the wall member preferably is optically transmissive for a least a portion of the spectral range of the emitted and reflected radiation.

To ensure that a sufficient amount of radiation power may reach the interior of the receiving chamber and subsequently the radiation sensor (reflected radiation), the wall member may have an optical transmittance of at least 20 percent, in particular of at least 50 percent, preferably of at least 75 percent, even more preferably of at least 80 percent for a least a portion of the spectral range of the emitted and reflected radiation. Preferably, the portion of the spectral range of the emitted and reflected radiation, for which the transmittance is above a respective one of the mentioned thresholds, covers at 20 percent, in particular at least 50 percent of the spectral range of the emitted and reflected radiation.

In general, the wall member may be made of a material that is different from a material of other portions of a wall which defines the receiving cavity. Alternatively, the wall member may be made of a material that is identical to a material of other portions of the wall which defines the receiving cavity.

The wall member may be made of one of the following materials: polytetrafluoroethylene (PTFE, also known as Teflon®) and polyether ether ketone (PEEK). Such materials ensure a sufficient transmittance. For example, for certain wavelengths PTFE can be which is opaque for visible light but transmissive for other wavelength ranges.

The wall member may have a wall thickness in a range of 0.1 millimeter to 2 millimeter, in particular 0.15 millimeter to 1 millimeter, preferably 0.2 millimeter to 0.5 millimeter. The wall thickness denotes the extension of the wall member transverse, in particular perpendicular to a surface of the wall member which defines an inner surface of the receiving cavity.

The receiving cavity may comprise an insertion opening through which an aerosol-generating article may be inserted into the receiving cavity. As used herein, the direction in which the aerosol-generating article is inserted is denoted as insertion direction. Preferably, the insertion direction corresponds to the extension of a length axis, in particular a center axis of the receiving cavity.

Upon insertion into the receiving cavity, at least a portion of the aerosol-generating article may still extend outwards through the insertion opening. The outwardly extending portion preferably is provided for interaction with a user, in particular for being taken into a user's mouth. Hence, during use of the device, the insertion opening may be close to the mouth. Accordingly, as used herein, sections close to the insertion opening or close to a user's mouth in use of the device, respectively, are denoted with the prefix "proximal". Sections which are arranged further away are denoted with the prefix "distal".

With regard to this convention, the receiving cavity may be arranged or located in a proximal portion of the aerosol-generating device. The insertion opening may be arranged or located at a proximal end of the aerosol-generating device, in particular at a proximal end of the receiving cavity.

Likewise, the receiving cavity may be formed as a cavity, in particular as an elongate cavity, which comprises a distal end portion and a proximal end portion. If present, an insertion opening may be arranged at a proximal end of the receiving cavity. At a distal end, the receiving cavity may comprise a bottom opposite to the insertion opening.

The wall member preferably is located at distal end portion of the receiving cavity. In particular, the wall member may form at least a portion of a bottom of the receiving cavity. Alternatively, the wall member may form at least a portion of a distal end portion of a side wall of the receiving cavity.

Accordingly, at least a part of the state detector, in particular the radiation emitter and the radiation sensor, may be arranged close to or adjacent to a distal end portion of the receiving cavity. In particular, the radiation emitter and the radiation sensor may be arranged close to or adjacent to a bottom of the receiving cavity. Likewise, the radiation emitter and the radiation sensor may be arranged close to or adjacent to a portion of a distal end portion of a side wall of the receiving cavity. Such arrangements are particularly advantageous in a configuration of the device where an air flow through the cavity passes a distal end portion of the cavity. In particular, this applies in cases where the air flow enters an aerosol-generating article, upon being received in the cavity, at a distal end portion of the cavity. For example, when the state detector is used for puff detection, an arrangement of the state detector close to or adjacent to these portions is advantageous as these portions are most sensitive to a change of the air density in the receiving cavity occurring during a user's puff.

In general, at least a part of the state detector, in particular the radiation emitter and the radiation sensor, may be arranged close to or adjacent to the wall member. In particular, at least a part of the state detector, in particular the radiation emitter and the radiation sensor, may be arranged at or at least partially within the wall member. As described above, the wall member may be a portion of a side wall or a bottom of the receiving cavity.

As used herein, the term "arranged at the wall member" in particular means that the respective components are arranged at a surface of the wall member opposite to another surface of the wall member which forms a least a portion of the inner surface of the receiving cavity.

An arrangement at least partially within a wall member may be advantageous to reduce absorbance effects and to increase the response time of the state detector. In addition, an arrangement at least partially within a wall member advantageously allows for a compact integration of at least a part of the state detector, in particular of the radiation emitter and the radiation sensor, in the aerosol-generating device. For example, at least a part of the state detector, such as the radiation emitter and the radiation sensor, may be integrated into the wall member of the receiving cavity.

The radiation emitter and the radiation sensor may be part of a sensing unit. The sensing unit may comprise a support body which the radiation emitter and the radiation sensor are attached to and which serves for mounting the sensing unit in the device. For example, the device may comprise a plug-in recess which is located at close to a bottom portion of the receiving cavity and which is configured to receive the sensing unit. For securely retained the sensing unit in the plug-in recess, the support body may comprise one or more snap fits which engage with corresponding snap-fits in the plug-in recess upon insertion of the sensing unit into the plug-in recess.

In addition to the radiation emitter and the radiation sensor, the state detector may further comprise an electrical circuitry for controlling operation of the radiation emitter and/or for converting an output signal of the radiation sensor into a signal indicative of the presence of at least one specific state in the receiving cavity. The electrical circuitry may comprise at least one of a transimpedance amplifier for current-to-voltage conversion, an inverting signal amplifier, a single-ended to-differential converter, an analog-digital converter and a micro-controller.

The aerosol-generating device may further comprise a controller operatively coupled with the state detector. The controller may be configured to determine the presence of at least one specific state in the receiving cavity based on an output signal provided by the state detector, in particular of the radiation sensor, which is indicative of the presence of at least one specific state in the receiving cavity.

The controller may further be configured to control the overall operation of the aerosol-generating device, in particular the heating process. Based on the signal indicative of the presence of at least one specific state in the receiving cavity, the controller may be configured to control the heating process in order to maintain the heating temperature at a certain level when a user takes a puff. Likewise, the controller may be configured to (preferably automatically) enable or initiate the heating process when the presence of an aerosol-generating article in the receiving cavity is detected, in particular by detecting a change of the intensity of the reflected radiation upon insertion of the aerosol-generating article into the receiving cavity. As another example, the controller may be configured to stop or disable heating when a displacement of the aerosol-generating article in the receiving cavity is detected, in particular by detecting a deviation of the intensity of the reflected radiation from a predefined value of the intensity of the reflected radiation. As another example, the controller may be configured to enable or disable operation of the device when an appropriate or inappropriate article type received in the receiving cavity is recognized, in particular by detecting a predefined value of the intensity of the reflected radiation corresponding to a specific article type.

The controller and at least parts of the state detector may be integral part of an overall electrical circuitry of the aerosol-generating device.

The aerosol-generating device may comprise a power supply, preferably a battery such as a lithium iron phosphate battery. As an alternative, the power supply may be another form of charge storage device such as a capacitor. The power supply may require recharging and may have a capacity that allows for the storage of enough energy for one or more user experiences. For example, the power supply may have sufficient capacity to allow for the continuous generation of aerosol for a period of around six minutes or for a period that is a multiple of six minutes. In another example, the power supply may have sufficient capacity to allow for a predetermined number of puffs or discrete activations of the heating device.

The aerosol-generating device may comprise at least one air inlet in fluid communication with the receiving cavity. Accordingly, the aerosol-generating system may comprise an air path extending from the at least one air inlet into the receiving cavity, and possibly further through the aerosol-forming substrate within the article and a mouthpiece into a user's mouth.

Preferably, the air inlet is realized at an insertion opening of the receiving cavity used for inserting the article into the cavity. When the article is received in the cavity, air may be drawn into the receiving cavity at the rim of the insertion opening and further through an air flow passage formed between the outer circumference of the aerosol-generating article and at least one or more portions of the inner surface of the receiving cavity.

The receiving cavity may comprise a plurality or protrusions extending in the interior of the receiving cavity. Preferably, the plurality of protrusions are distanced from each other such that an air flow passage is formed in between neighboring protrusions, that is, by the interstices (free space) between neighboring protrusions, In addition, the plurality or protrusions may be configured to contact at least a portion of the aerosol-generating article for retention of the aerosol-generating article in the receiving cavity.

At least one, in particular each of the plurality of protrusions may comprise or may be formed as or may be a rib. Preferably, the one or more ribs extend along a direction of a length axis, in particular a center axis of the receiving cavity. Preferably, the length axis of the receiving cavity corresponds to an insertion direction along which an aerosol-generating article is insertable into the receiving cavity.

The ribs may be symmetrically arranged around the length axis, in particular the center axis. In particular, the ribs may be arranged equally spaced around the length axis, in particular the center axis. Any of these configurations is advantageous with regard to an improved air flow management of the device. As described above, the term "extending along a direction of the length axis, in particular the center axis includes both, an extension parallel to the center axis as well as an extension in the general direction of the center axis, which may be inclined with regard to the center axis (for example, by 2 degree to 5 degree), but still lying in a respective common plane with the center axis. The latter in particular applies to a substantially tapered, for example conical or frustoconical shape of the receiving cavity as mentioned further below.

The one or more ribs may have a substantially triangular cross-sectional shape. Alternatively, one or more ribs may have a substantially rectangular or substantially trapezoid or a substantially semi-oval or a substantially semi-circular cross-sectional shape.

The one or more ribs may comprise a contact surface which preferably is adapted to the shape of a respective portion of the aerosol-generating article which the contact surface gets into contact with upon insertion of the article into the receiving cavity At least one, in particular each of the plurality of protrusions may be chamfered or may comprise at least one chamfer. Preferably, the respective protrusions may be chamfered at a side facing towards an insertion opening of the receiving cavity or may comprise at least one chamfer facing towards an insertion opening of the receiving cavity. Advantageously, this facilitates insertion of the article into the receiving cavity. Likewise, the respective protrusions may be chamfered at a side facing away form an insertion opening of the receiving cavity or may comprise at least one chamfer facing away from an insertion opening of the receiving cavity. Advantageously, this facilitates removal of the article from the receiving cavity.

The aerosol-generating device may comprise one or more end stops arranged within the receiving cavity, in particular at a distal end of the receiving cavity. The one or more end stops preferably are configured to limit an insertion depth of an aerosol-generating article into the receiving cavity. In particular, the one or more end stops may be configured to prevent an aerosol-generating article from abutting the inner surface of the receiving cavity at a distal end of the receiving cavity that is opposite to an insertion opening of the receiving cavity at a proximal end of the receiving cavity. Thus, the one or more end stops advantageously provide free space within a distal portion of the receiving cavity allowing free air flow between a distal end of the receiving cavity and a distal end of an aerosol-generating article when the article is received in the receiving cavity. The free space or gap volume within a distal portion of the receiving cavity close to the bottom of the cavity advantageously may serve as an aerosol-detection cavity.

The one or more end stops may comprise a contact surface which an aerosol-generating article, in particular a distal end of an aerosol-generating article may abut when the article is received in the receiving cavity.

Preferably, the aerosol-generating device may comprise a plurality of separate end stops, for example three end stops, which are arranged within the receiving cavity, in particular at a distal end of the receiving cavity.

The plurality of end stops may be symmetrically arranged around a length axis, in particular a center axis of the receiving cavity. In particular, the plurality of end stops may be arranged equally spaced around the length axis, in particular the center axis of the receiving cavity. As described above, this enables free air flow around the end stops and an article received in the receiving cavity.

The electrical heater of the aerosol-generating device may be an inductive heater. The inductive heater may comprise an induction source including an inductor which is configured to generate an alternating, in particular high-frequency electromagnetic field within the receiving cavity. The alternating, in particular high-frequency electromagnetic field may be in the range between 500 kHz (kilo-Hertz) to 30 MHz (Mega-Hertz), in particular between 5 MHz to 15 MHz, preferably between 5 MHz and 10 MHz. Upon inserting an article into the receiving cavity, the alternating electromagnetic field is used to inductively heat a susceptor which is in thermal contact with or thermal proximity to an aerosol-forming substrate to be heated. The inductor may be arranged such as to surround at least a portion of the receiving cavity or at least a portion of the inner surface of the receiving cavity, respectively. The inductor may be an inductor coil, for example a helical coil, arranged within a side wall of the receiving cavity. The inductor may be arranged such as to surround only a distal portion of the inner surface of the receiving cavity. Likewise, the inductor may be arranged such as to surround at least an intermediate axial portion of the inner surface of the receiving cavity, wherein the intermediate axial portion is located between a distal portion and a proximal portion of the inner surface of the receiving cavity.

Alternatively, the heater may be a resistive heater comprising a resistive heating element. The heating resistive element is configured to heat up when an electrical current is passed therethrough due to an immanent ohm resistance or resistive load of the resistive heating element. For example, the resistive heating element may comprise at least one of a resistive heating wire, a resistive heating track, a resistive heating grid or a resistive heating mesh. In use of the device, the resistive heating element is in thermal contact with or thermal proximity to an aerosol-forming substrate to be heated.

In general, the receiving cavity may have any suitable shape. In particular, the shape of the receiving cavity may correspond to the shape of the aerosol-generating article to be received therein. Preferably, the receiving cavity may have a substantially cylindrical shape or a tapered shape, for an example substantially conical or substantially frustoconical shape.

Likewise, the receiving cavity may have any suitable cross-section as seen in a plane perpendicular to a length axis of the receiving cavity or perpendicular to an insertion direction of the article. In particular, the cross-section of the receiving cavity may correspond to the shape of the aerosol-generating article to be received therein. Preferably, the receiving cavity has a substantially circular cross-section. Alternatively, the receiving cavity may have a substantially elliptical cross-section or a substantially oval cross-section or a substantially square cross-section or a substantially rectangular cross-section or a substantially triangular cross-section or a substantially polygonal cross-section. As used herein, the above mentioned shapes and cross-sections preferably refer a shape or a cross-section of the receiving cavity without considering any protrusions.

The device may comprise a controller module and a receiving cavity module. Advantageously, this allows for a modular assembly of the aerosol-generating device. The controller module preferably comprises the controller and the power supply. The receiving cavity module may comprise at least the receiving cavity, the radiation emitter and the radiation detector. Preferably, the receiving cavity module may comprise at least parts of the electrical heater. For example, if the heater is an inductive heater. The receiving cavity module may comprise an induction coil. The induction coil may be integrated in a wall defining the receiving cavity. For example, the induction coil may be integrated in a wall side of the receiving cavity, in particular such as to surround at least a portion of the interior of the receiving cavity. The receiving cavity module may be formed as a tubular sleeve, which may be inserted into the controller module of the aerosol-generating device.

Alternatively, at least a part of the receiving cavity may be integrally formed with a main body of the aerosol-generating device. By providing at least a part of the receiving cavity as a part of the main body the quantity of parts need to build up the aerosol-generating device may be reduced.

The present invention further relates to an aerosol-generating system comprising an aerosol-generating device according to the invention and as described herein. The system further comprises an aerosol-generating article including at least one aerosol-forming substrate to be heated by the device, wherein at least a portion of the article is removably receivable or removably received in the receiving cavity of the device.

The aerosol-generating article may be a consumable, in particular intended for single use. The aerosol-generating article may be a tobacco article. In particular, the article may be a rod-shaped article, preferably a cylindrical rod-shaped article, which may resemble conventional cigarettes.

The article may comprise one or more of the following elements: a first support element, a substrate element, a second support element, a cooling element, and a filter element. Preferably, the aerosol-generating article comprises at least a first support element, a second support element and a substrate element located between the first support element and the second support element.

All of the aforementioned elements may be sequentially arranged along a length axis of the article in the above described order, wherein the first support element preferably is arranged at a distal end of the article and the filter element preferably is arranged at a proximal end of the article. Each of the aforementioned elements may be substantially cylindrical. In particular, all elements may have the same outer cross-sectional shape. In addition, the elements may be circumscribed by an outer wrapper such as to keep the elements together and to maintain the desired cross-sectional shape of the rod-shaped article. Preferably, the wrapper is made of paper.

As used herein, the term "aerosol-forming substrate" relates to a substrate capable of releasing volatile compounds that can form an aerosol when heated. The aerosol-forming substrate may be a solid or a liquid aerosol-forming substrate. The aerosol-forming substrate may comprise a tobacco-containing material containing volatile tobacco flavor compounds, which are released from the substrate upon heating. Alternatively or additionally, the aerosol-forming substrate may comprise a non-tobacco material. The aerosol-forming substrate may further comprise an aerosol former. Examples of suitable aerosol formers are glycerin and propylene glycol. The aerosol-forming substrate may also comprise other additives and ingredients, such as nicotine or flavoring substances. In particular, liquid aerosol-forming substrate may include water, solvents, ethanol, plant extracts and natural or artificial flavors. The aerosol-forming substrate may also be a paste-like material, a sachet of porous material comprising aerosol-forming substrate, or, for example, loose tobacco mixed with a gelling agent or sticky agent, which could include a common aerosol former such as glycerin, and then is compressed or molded into a plug.

The substrate element preferably comprise the at least one aerosol-forming substrate to be heated. In case the aerosol-generating system is based on induction heating, the substrate element may further comprise a susceptor which is in thermal contact with or thermal proximity to the aerosol-forming substrate. As used herein, the term "susceptor" refers to an element comprising a material that is capable of being inductively heated within an alternating electromagnetic field. This may be the result of at least one of hysteresis losses or eddy currents induced in the susceptor, depending on the electrical and magnetic properties of the susceptor material.

At least one of the first support element and the second support element may comprise a central air passage. Preferably, at least one of the first support element and the second support element may comprise a hollow cellulose acetate tube. Alternatively, the first support element may be used to cover and protect the distal front end of the substrate element.

The aerosol-cooling element is an element having a large surface area and a low resistance to draw, for example 15 mmWG to 20 mmWG. In use, an aerosol formed by volatile compounds released from the substrate element is drawn through the aerosol-cooling element before being transported to the proximal end of the aerosol-generating article.

The filter element preferably serves as a mouthpiece, or as part of a mouthpiece together with the aerosol-cooling element. As used herein, the term "mouthpiece" refers to a portion of the article through which the aerosol exits the aerosol-generating article.

In addition, the article may comprise an optical marker. The optical marker may be used to mark and identify a specific type of the article. The marker may be detectable by the state detector of the aerosol-generating device when the aerosol-generating article is received in the cavity of the device.

Preferably, the optical marker is a passive optical marker comprising a retro-reflective material, which reflects incoming radiation emitted from the radiation emitter towards the radiation sensor. For example, the optical marker may be sticker attached to the outer surface of the aerosol-generating article. Accordingly the specific type of such an article—when being received in the receiving cavity—may be recognized by detecting a predefined value of the intensity of the reflected radiation corresponding to the specific article type.

Further features and advantages of the aerosol-generating system and the aerosol-generating article according to the present invention have already been described above with regard to aerosol-generating device and equally apply.

FIG. 1 schematically illustrates an exemplary embodiment of an aerosol-generating device 200 according to the present invention. The aerosol-generating device 200 has an elongated shape and comprises a controller module 210 and a receiving cavity module 220. The cavity module 220 comprises a receiving cavity 221 for receiving at least a portion of an aerosol-generating article 2. The receiving cavity module 220 is inserted into a recess 230 formed within a proximal portion 211 of the controller module 210. Within a distal portion 212, the controller module 210 comprises a power source 250 and a controller 260 for powering and controlling operation of the device 200. Together, the aerosol-generating device 200 and the aerosol-generating article 2 form an aerosol-generating system according to the present invention.

Within the proximal portion 211 of the controller module 210 that forms the cavity 230, the aerosol-generating device comprises an inductor 240. In the present embodiment, the inductor 240 is a helical coil arranged around the receiving cavity 221. The inductor 240 is part of an inductive heater that is powered and operated by the power source 250 and the controller 260. In use of the device 200, the inductor 240 generates an alternating electromagnetic field within the receiving cavity 221 to inductively heat an aerosol-forming substrate contained in the article 2, when the latter is received in the receiving cavity 221. Alternatively, the inductor 240 may be part of the receiving cavity module 220.

Figure 2:
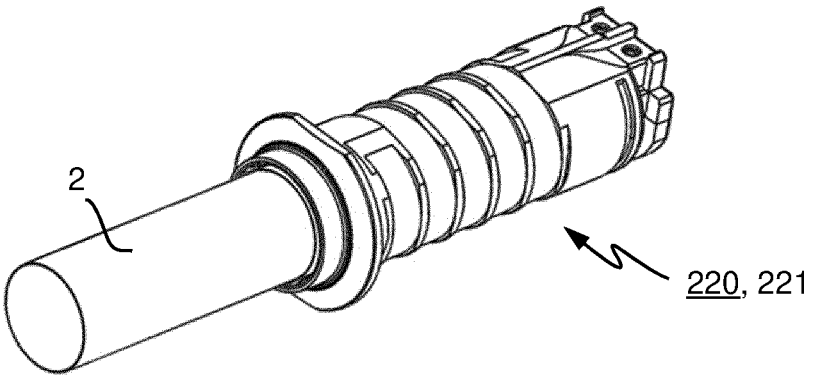
FIG. 2 schematically illustrates a receiving cavity module of the device according to FIG. 1 in a perspective view together with an aerosol-generating article introduced therein.
Figure 3:
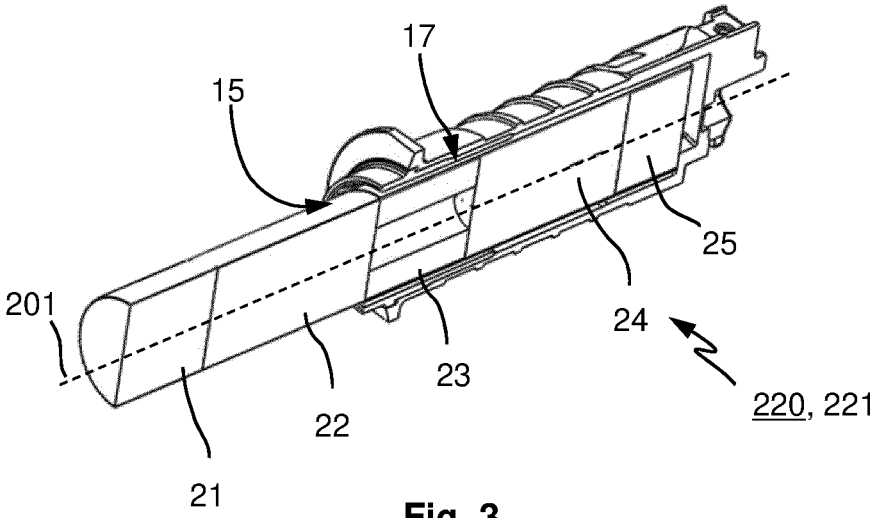
FIG. 3 schematically illustrates the receiving cavity module and the aerosol-generating article according to FIG. 2 in a perspective sectional view.
Figure 4:
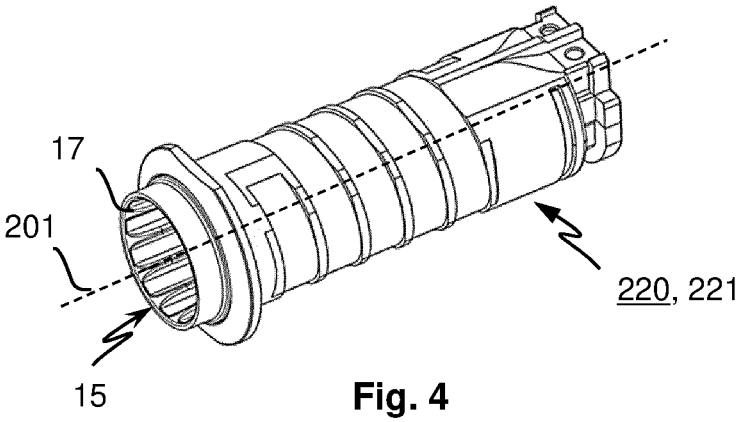
FIG. 4 schematically illustrates the receiving cavity module according to FIG. 2 without the aerosol-generating article.

FIG. 2, FIG. 3 and FIG. 4 show different aspects of the receiving cavity module 220 with and without the aerosol-generating article 2. As can be seen, the receiving cavity module 220 is an elongated sleeve comprising an insertion opening 15 through which the aerosol-generating article 2 may be inserted at least partially into the receiving cavity 221. The insertion direction of the aerosol-generating article 2 substantially extends along a center axis 201 of the receiving cavity 221. The receiving cavity 221 is made of PEEK (polyether ether ketone). The receiving cavity 221 has a substantially cylindrical shape with a substantially circular cross-section having a diameter of about 15 millimeter.

Corresponding to the shape of the receiving cavity 221, the aerosol-generating article 2 has a substantially cylindrical rod-shape. As shown in FIG. 1 and FIG. 3, the article 2 comprises five elements sequentially arranged along a length axis of the article 2: a first support element 25, a substrate element 24, a second support element 23 comprising a central air passage 26, a cooling element 22 and a filter element 21. The first support element 25 is arranged at a distal end of the article 2 and the filter element 21 is arranged at a proximal end of the article 2. Each of the aforementioned elements 21, 22, 23, 24, 25 is substantially cylindrical, all of them having the same outer cross-sectional shape. In addition, the elements are circumscribed by an outer wrapper such as to keep the elements together and to maintain the desired circular cross-sectional shape of the rod-shaped article 2. Preferably, the wrapper is made of paper. The first support element 25 is used to cover and protect the distal front end of the substrate element 24. The substrate element 24 comprise the at least one aerosol-forming substrate to be heated. In addition, the substrate element 24 further comprises a susceptor (not shown) which is in thermal contact with the aerosol-forming substrate. Upon activating the inductor 240, the susceptor is heated due to at least one of eddy currents or hysteresis losses which are induced by the electromagnetic field, depending on the electrical and magnetic properties of the susceptor material. The susceptor heats up until reaching a temperature sufficient to vaporize material from the aerosol-forming substrate. The released material may be entrained in an air flow passing through the article 2 from the first support element 25 through the substrate element 24, the second support element 23 and the cooling element 22 towards the filter element 21. Along this way, the vaporized material cools to form an aerosol before escaping through the filter element 21 at the proximal end of the article 2.

Figure 5:
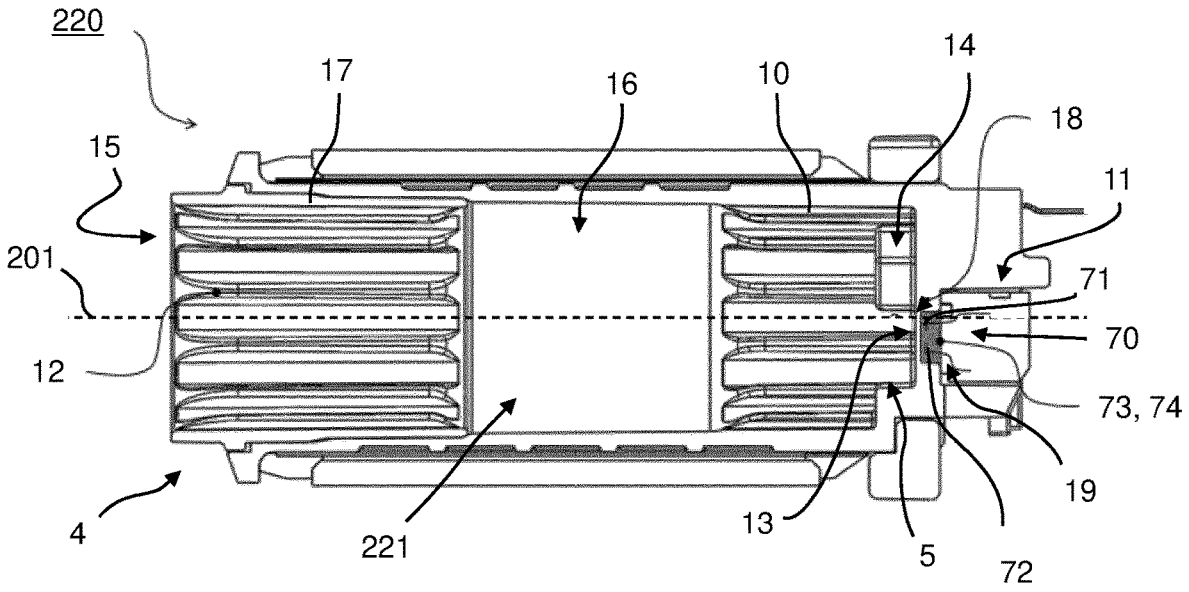
FIG. 5 schematically illustrates a sectional view of the receiving cavity according to FIG. 4 without the aerosol-generating article.

FIG. 5 illustrates further details of the receiving cavity module 220 and the receiving cavity 221, respectively. The receiving cavity 221 comprises an inner surface 16 which comprises a plurality of first and second protrusion 10, 17. As can be seen in FIG. 1 and FIG. 3, when the article 2 is received in the cavity 221, the first support element 25 is in contact with the first protrusions 10 and the second support element 23 is in contact with the second protrusions 17. In contrast, the substrate element 24 is without any contact to the inner surface 16 of the heating cavity 221. Advantageously, this leads to an overall reduction of heat losses as there is no direct thermal conduction from the aerosol-generating article 2 to the inner surface 16 in that part of the cavity 221. Furthermore, adverse moistening effects on the article due to condensate formation in the cavity 221 are reduced as well. In the present embodiment, the first and the second protrusions 10, 17 are formed as ribs extending along a direction parallel to the center axis 201. The ribs are symmetrically arranged around the center axis 201 and equally spaced to each other. The spacing between neighboring ribs is in a range of 1.3 millimeter to 1.5 millimeter. With regard to its length extension, each rib is chamfered or comprises a respective chamfer at both ends, that is, at a side facing the insertion opening 15 and at an opposite side facing away from the insertion opening 15. Advantageously, the chamfers facilitate insertion and removal of the aerosol-generating article 2 into and from the receiving cavity 221. Apart from that, each rib has a constant height extension along its length extension. In the present embodiment, the height is in range of 0.4 millimeter to 0.5 millimeter as measured in a radial direction towards the center axis 201.

The first protrusions 10 and the second protrusions 17 fall in line, that is, each of the first protrusions 10 is aligned with a respective one of the second protrusions 17 as seen in a direction parallel to the center axis 201. Due to this, the interstices (free space) in between neighboring first protrusions 10 and in between neighboring second protrusions 17 advantageously form a multi-channel air flow passage 12 which extends form the insertion opening 15 at the proximal end 4 of the receiving cavity 221 to the bottom of the receiving cavity 221 at its distal end 5.

Accordingly, when a negative pressure is applied at the filter element 21 of an aerosol-generating article 2 received in the receiving cavity 221, for example when a user takes a puff, air is drawn into the receiving cavity 221 at the rim of the insertion opening 15 and further along the multi-channel air flow passage 12 into the bottom portion at the distal end 5 of the receiving cavity 221. There, the air flow enters the aerosol-generating article 2 through the first support element 25 and further passes through the substrate element 24, the second support element 23, the aerosol cooling element 22 and the filter element 21 where it finally exits the article 2. In the substrate element 24, vaporized material from the aerosol-forming substrate is entrained into the air flow. Subsequently, the vaporized material and the air cool down as they pass through the second support element 23, the aerosol cooling element 22 and the filter element 21, thereby forming an aerosol.

In order to enable a proper redirection of the air flow into the aerosol-generating article 2 at the bottom portion of the receiving cavity 221, the aerosol-generating device 200 comprises three end stops 14 which are arranged at the distal end 5 of the receiving cavity 221. The end stops 14 are configured to limit the insertion depth of the article 2 into the receiving cavity 221 and, thus, to prevent the article 2 from abutting the bottom surface of the receiving cavity 221. This is shown in FIG. 1.

As mentioned above, detection of certain conditions and states in the receiving cavity is important for various purposes and reasons such as to ensure a proper functioning of the device. For example, it is important to accurately detect a user's puff in order to counter variations of the heating temperature when a user takes a puff. In other cases, it may be required to detect the presence or a displacement of an aerosol-generating article in the receiving cavity in order to enable or disable the heating process. Likewise, recognition of the article type may be required to ensure that only appropriate articles are used with a respective device.

For these purposes, the aerosol-generating device 200 according to the present embodiment comprises a state detector 70 that is configured to detect the presence of at least one specific state in the receiving cavity. For this, the state detector 70 comprises a radiation emitter 71 and a radiation sensor 72. As can be seen in FIG. 1 and FIG. 5, the radiation emitter 71 is arranged and configured to emit radiation into the receiving cavity 221. Likewise, the radiation sensor is arranged and configured to detect a portion of the emitted radiation that is reflected from the interior of the receiving cavity 211 and thus possibly indicative for the presence of the at least one specific state.

In the present embodiment, the state detector 70 is located at a distal end portion of the cavity 221, opposite to the insertion opening 15. As will be explained in detail further below, this position is particularly suitable for detecting a plurality of different conditions and states in the receiving cavity 221.

In the present embodiment, the radiation emitter 71 is a light-emitting diode (LED) emitting red light at about 670 nm±50 nm.

The radiation sensor 72 is a photodiode having a spectral sensitivity which matches the spectral range of the light emitted from the radiation emitter 71. Preferably, the photodiode is a Si (silicon) photodiode.

As can be further seen in FIG. 5, the radiation emitter 71 and the radiation sensor 72 are arranged adjacent to a wall member 18 which separates the radiation emitter 71 and the radiation sensor 72 from the interior of the receiving cavity 221. The wall member 18 forms a portion of the bottom of the receiving cavity 221. The radiation emitter 71 and the radiation sensor 72 are received in a recess 19 in the bottom wall of the receiving cavity on a side opposite to the inner surface 16 of the cavity 221.

To ensure that a sufficient amount of radiation power passes from the radiation emitter 71 through the wall member 18 into the interior of the receiving chamber 211 and subsequently (reflected radiation) back from the interior of the cavity 221 through the wall member 18 towards the radiation sensor 71, the wall member 18 is optically transmissive for a least a portion of the spectral range of the emitted and reflected radiation. For example, the wall member 18 may have an optical transmittance of at least 20 percent, in particular of at least 50 percent, preferably of at least 75 percent, even more preferably of at least 80 percent for a least a 20 percent of the spectral range of the emitted and reflected radiation. For this, the wall member 19 preferably is rather thin having a wall thickness in a range of 0.1 millimeter to 2 millimeter, in particular 0.15 millimeter to 1 millimeter, preferably 0.2 millimeter to 0.5 millimeter. For example, for a light-emitting diode (LED) emitting red light at about 670 nm±50 nm as in the present embodiment, the wall member 18 may be made of PEEK and may have a wall thickness of 0.2 mm.

In general, the wall member 18 may be made of a material that is different from a material of other portions of the wall which defines the receiving cavity. Alternatively, the wall member 18 may be made of a material that is identical to a material of other portions of the wall which defines the receiving cavity.

As can be also seen in FIG. 1 and FIG. 5, the radiation emitter 71 and the radiation sensor 72 are part of a sensing unit 73. The sensing unit 73 comprises a support body 74 which the radiation emitter 71 and the radiation sensor 72 are attached to and which serves for mounting the sensing unit 73 to the receiving cavity module 220. As shown in FIG. 5, the receiving cavity module 220 comprises a plug-in recess 11 which is located at a bottom portion of the receiving cavity module 220 and which is configured to receive the sensing unit 73. For securely retained the sensing unit 73 in the plug-in recess 11, the support body 74 may comprise one or more snap fits which engage with corresponding snap-fits in the plug-in recess 11 upon insertion of the sensing unit 73 into the plug-in recess 11.

The sensing unit 70 further comprises electrical connector elements to operatively connect the radiation emitter 71 and the radiation sensor 72 with an electrical circuitry (not shown) of the state detector 70. The electrical circuitry is configured to control operation of the radiation emitter 71 and to convert the output signal of the radiation sensor 72 into a signal indicative of the presence of at least one specific state in the receiving cavity 221. The electrical circuitry of the state detector 70 may be integral part of the controller 260. Based on an output signal provided by the state detector 70, the controller 260 may take different actions to affect operation of the device. This will be now explained with regard to FIG. 6, FIG. 7 and FIG. 8, which show different applications of the state detector according to the present invention.

Figure 6:
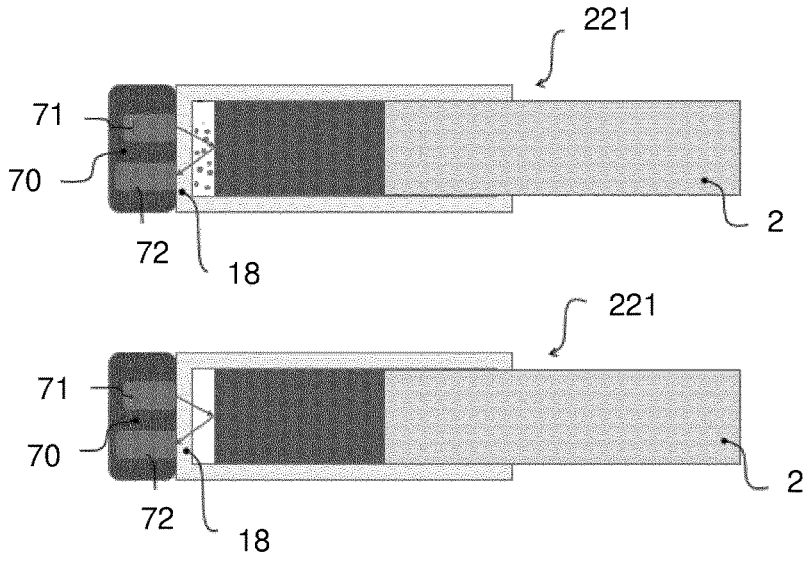
FIG. 6 schematically illustrates an embodiment of the aerosol-generating device according to the present invention in a first state detection application.

FIG. 6 schematically illustrates a first application of the state detector 70 serving as a puff detector. The lower part of FIG. 6 shows the aerosol-generating system in a state when a user takes a puff. In contrast, the upper part of FIG. 6 shows the aerosol-generating system in a state between two puffs, that is, when a user does not take a puff. As explained above, when a user takes a puff, air is drawn through the receiving cavity 221. The airflow causes the air density in the receiving cavity 221 to change. This applies in particular for the gap volume between the bottom of the receiving cavity 221 and the distal end of the aerosol-generating article 2 that is formed in between the end stops 14 (see FIG. 1 and FIG. 5). The change of the air density is mainly due to side stream aerosol that fills the gap volume between puffs and which is evacuated from the gap volume when a user tales a puff. Accordingly, the gap volume close to the bottom of the receiving cavity 221 serves as an aerosol-detection cavity. The change of the air density causes a change of the optical transmittance and absorbance properties of the gap volume. This in turn causes a change of the intensity of the radiation which is emitted from the radiation emitter 71 into and subsequently reflected from the interior of the receiving cavity 221 towards the radiation sensor 72, where it is detected. Thus, the change of the intensity of the reflected light is indicative for a user's puff. Based on a corresponding output signal provided by the state detector 70 indicating the occurrence of a user's puff, the heating process may be adapted, for example, to counter variations of the heating temperature that are due to the cooling effects of the airflow through the device during a user's puff.

Figure 7:
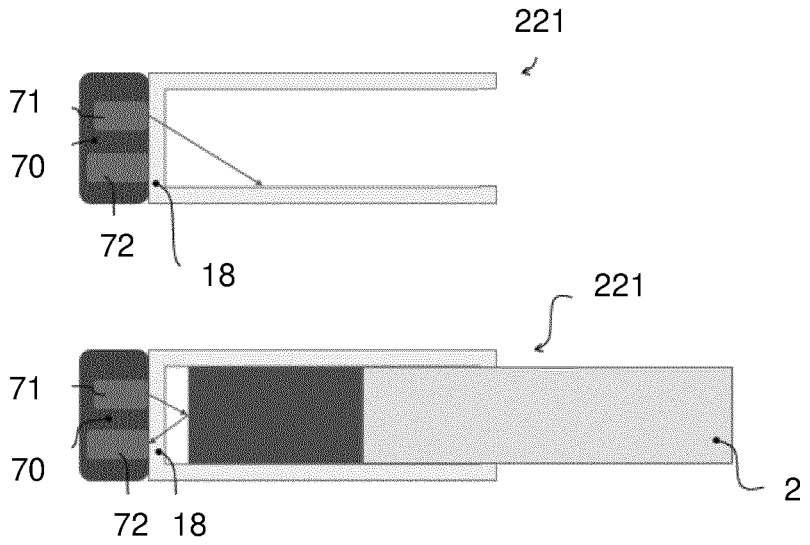
FIG. 7 schematically illustrates an embodiment of the aerosol-generating device according to the present invention in a second state detection application.

FIG. 7 schematically illustrates a second application of the state detector 70 serving to detect the insertion or (non-)presence of an aerosol-generating article 2 in the receiving cavity 221. The upper part of FIG. 7 shows the receiving cavity 221 before insertion of an aerosol-generating article, whereas the lower part of FIG. 7 shows the receiving cavity 221 after insertion of an article. As indicated by the arrows, insertion of the article causes radiation that is emitted from the radiation emitter 71 into the cavity 221 to be reflected differently as compared to the situation without an article being received in the cavity 221. Accordingly, the intensity of the reflected light that is detected by the radiation sensor 72 changes when an article 2 is inserted into the cavity 2. Thus, the change of the intensity of the reflected light is indicative for the insertion or (non-)presence of an aerosol-generating article 2 in the receiving cavity 2. Based on a corresponding output signal provided by the state detector 70 indicating the insertion or (non-) presence of an article 2 in the cavity 221, the heating process may be enabled or disabled. Preferably, the device is configured such as to automatically initiate the heating process when the insertion or presence of an article 2 in the cavity 221 is detected by the state detector 70.

Figure 8:
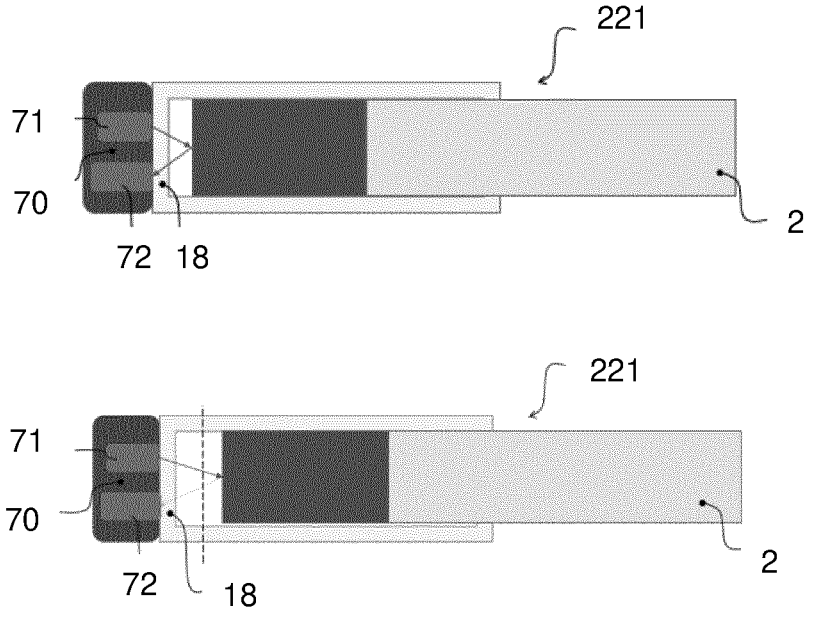
FIG. 8 schematically illustrates an embodiment of the aerosol-generating device according to the present invention in a third state detection application.

FIG. 8 schematically illustrates a third application of the state detector 70 serving to detect a displacement of an aerosol-generating article 2 from a pre-defined or desired position in the reviving cavity 221. Displacement of the article 2 may be due to a misplacement of the article 2 upon insertion in the receiving cavity 221 or during use of the device due to some mechanical influence. The upper part of FIG. 8 shows a proper placement of the article 2 at a pre-defined or desired position in the reviving cavity 221, whereas the lower part of FIG. 8 shows the article being displaced from the pre-defined or desired position (see dashed line). Like in the other applications shown in FIG. 6 and FIG. 7, the displacement of the article 2 causes a deviation of the intensity of the reflected radiation from a predefined intensity value when being detected by the radiation sensor 72. The predefined intensity value corresponds to pre-defined or desired position. Thus, the deviation of the intensity of the reflected radiation is indicative for the displacement of the article 2. Based on corresponding output signal provided by the state detector 70 indicating the displacement of an article 2 in the cavity 221, the heating process may be, for example, disabled.

The invention claimed is:

1. An electrically heatable aerosol-generating device configured to heat an aerosol-forming substrate to form an inhalable aerosol when heated, the electrically heatable aerosol-generating device comprising:

a receiving cavity configured to removably receive at least a portion of an aerosol-generating article including the aerosol-forming substrate;

an electrical heater configured to heat the aerosol-forming substrate when the aerosol-generating article is received in the receiving cavity; and a state detector configured to detect a presence of at least one specific state in the receiving cavity, the state detector comprising a radiation emitter arranged and configured to emit radiation into the receiving cavity, and a radiation sensor arranged and configured to detect a portion of the emitted radiation being reflected from an interior of the receiving cavity and indicative of the presence of the at least one specific state, wherein the radiation emitter and the radiation sensor are arranged outside the receiving cavity such that the radiation emitter and the radiation sensor are not in fluid communication with the interior of the receiving cavity, and wherein at least a part of the state detector is arranged close to or adjacent to a distal end portion of the receiving cavity.

2. The electrically heatable aerosol-generating device according to claim 1, wherein the state detector is further configured to detect at least one of:

detect a user's puff by detecting a change of the intensity of the reflected radiation due to a change of air density in the receiving cavity occurring during the user's puff, detect the presence of the aerosol-generating article in the receiving cavity by detecting a change of the intensity of the reflected radiation upon insertion of the aerosol-generating article into the receiving cavity, detect a displacement of the aerosol-generating article in the receiving cavity by detecting a deviation of the intensity of the reflected radiation from a predefined value of the intensity of the reflected radiation, and recognize a specific type of the aerosol-generating article received in the receiving cavity by detecting a predefined value of the intensity of the reflected radiation corresponding to the specific article type.

3. The electrically heatable aerosol-generating device according to claim 1, wherein the radiation emitter is further configured to emit radiation having a spectral range between 400 nm and 1300 nm.

4. The electrically heatable aerosol-generating device according to claim 1, wherein the radiation emitter is further configured to emit radiation having a spectral range between 400 nm and 700 nm.

5. The electrically heatable aerosol-generating device according to claim 1, wherein the radiation emitter is further configured to emit radiation having a spectral range between 700 nm and 1300 nm.

6. The electrically heatable aerosol-generating device according to claim 1, wherein the radiation emitter and the radiation detector are separated from the interior of the receiving cavity by a wall member, which forms a portion of a wall defining the receiving cavity, and wherein the wall member is optically transmissive for a least a portion of a spectral range of the emitted and the reflected radiation.

7. The electrically heatable aerosol-generating device according to claim 6, wherein the wall member has an optical transmittance of at least 20 percent for a least a portion of the spectral range of the emitted and the reflected radiation.

8. The electrically heatable aerosol-generating device according to claim 6, wherein the wall member has an optical transmittance of at least 50 percent for a least a portion of the spectral range of the emitted and the reflected radiation.

9. The electrically heatable aerosol-generating device according to claim 6, wherein the wall member is made of polytetrafluoroethylene or polyether ether ketone.

10. The electrically heatable aerosol-generating device according to claim 6, wherein the wall member has a wall thickness in a range of 0.1 millimeter to 2 millimeters.

11. The electrically heatable aerosol-generating device according to claim 1, wherein the radiation emitter comprises a light-emitting diode.

12. The electrically heatable aerosol-generating device according to claim 1, wherein the radiation sensor comprises a photodiode.

13. The electrically heatable aerosol-generating device according to claim 1, further comprising a controller module and a receiving cavity module, wherein the receiving cavity module comprises the receiving cavity, the radiation emitter, and the radiation sensor.

14. An aerosol-generating system comprising the electrically heatable aerosol-generating device according to claim 1, and an aerosol-generating article removably received or receivable in the receiving cavity of the electrically heatable aerosol-generating device.

15. The aerosol-generating system according to claim 14, wherein the aerosol-generating article comprises an optical marker.

* * * * *